US006994613B2

(12) United States Patent
Hacikyan

(10) Patent No.: US 6,994,613 B2
(45) **Date of Patent: *Feb. 7, 2006**

(54) GRINDING APPARATUS WITH SPLASH PROTECTOR AND IMPROVED FLUID DELIVERY SYSTEM

(76) Inventor: Michael Hacikyan, 1576 Sweet Home Rd., Amherst, NY (US) 14228

( * ) Notice: Subject to any disclaimer, the term of this patent is extended or adjusted under 35 U.S.C. 154(b) by 0 days.

This patent is subject to a terminal disclaimer.

(21) Appl. No.: 10/753,751

(22) Filed: Jan. 8, 2004

(65) Prior Publication Data

US 2004/0203327 A1 Oct. 14, 2004

Related U.S. Application Data

(63) Continuation-in-part of application No. 10/383,235, filed on Mar. 6, 2003, now Pat. No. 6,896,601.

(60) Provisional application No. 60/370,574, filed on Apr. 5, 2002.

(51) Int. Cl.
*B24B 23/00* (2006.01)

(52) U.S. Cl. ..... 451/358; 451/450; 451/455

(58) Field of Classification Search ..... 451/356, 451/358, 361, 231, 451, 241, 44, 450, 411, 451/446, 449, 455, 178
See application file for complete search history.

(56) References Cited

U.S. PATENT DOCUMENTS 2,604,823 A 7/1952 Szypulinski
4,516,357 A * 5/1985 Gach ..... 451/231
4,543,021 A 9/1985 Adler
4,551,948 A * 11/1985 Kindig et al. ..... 451/231
4,884,927 A 12/1989 Menker
5,056,969 A 10/1991 Nerland et al.
5,342,156 A 8/1994 Baba
5,345,726 A * 9/1994 Gach ..... 451/450
5,423,359 A 6/1995 Aigner
5,527,207 A 6/1996 Azar et al.
5,549,509 A * 8/1996 Hirst et al. ..... 451/178
5,685,105 A 11/1997 Teetzel
6,083,086 A * 7/2000 Hacikyan ..... 451/59
6,176,656 B1 1/2001 Seong
6,241,589 B1 6/2001 Hacikyan
6,416,394 B1 7/2002 Hacikyan et al.

* cited by examiner

*Primary Examiner*—Dung Van Nguyen
(74) *Attorney, Agent, or Firm*—Walter W. Duft

(57) ABSTRACT

A glass grinding apparatus includes a base, a support grid mounted on the base to carry a work piece for grinding, a fluid holder disposed below the support grid, a drive shaft for rotating a grinding bit above the support grid, a power source for rotating the drive shaft, a fluid applicator for applying irrigation fluid to a grinding bit mounted on the drive shaft, and a splash protector adapted for connection to the grinding apparatus adjacent to the drive shaft to trap irrigation fluid and grinding debris sludge that are spun off from the grinding bit as it is rotated during grinding operations. The fluid applicator is formed as a fluid transfer brush that wicks irrigation fluid from the fluid holder to the grinding bit.

52 Claims, 18 Drawing Sheets

GRINDING APPARATUS WITH SPLASH PROTECTOR AND IMPROVED FLUID DELIVERY SYSTEM

CROSS-REFERENCE TO RELATED APPLICATIONS

The present application is a continuation-in-part of U.S. patent application Ser. No. 10/383,235, filed on Mar. 6, 2003, now U.S. Pat. No. 6,896,601, entitled "Grinding Apparatus With Splash Protector And Improved Fluid Delivery System," which claims the benefit under 35 U.S.C. 119(b) of U.S. Provisional Patent Application Ser. No. 60/370,574, filed on Apr. 5, 2002, entitled "Grinding Bit Cleaners, Coolant Feeder, and Splash Protector."

BACKGROUND OF THE INVENTION

1. Field of the Invention

The present invention relates generally to grinding apparatus. More particularly, the invention concerns glass grinding apparatus, and especially table top grinders for use by hobbyists in the fabrication of glass artwork and decorative glass products.

2. Description of Prior Art

By way of background, there is a wide variety of grinding apparatus for shaping and/or surfacing many different kinds of materials. Of particular interest herein are table-top grinders of the type used by glass hobbyists and the like. Commonly assigned U.S. Pat. No. 6,416,394, entitled "Planer/Grinder For Glass," whose contents are incorporated herein by this reference, exemplifies such equipment. The typical glass grinding apparatus includes a cylindrical grinding bit mounted on a motor-driven shaft that spins above a horizontal work piece platform. The grinding bit can be formed with a surface coating of diamonds or other abrasive particles capable of grinding, sanding or polishing glass. A glass work piece that is to be shaped or otherwise treated is placed on the platform and advanced until its edge contacts the grinding bit. By maneuvering the work piece relative to the grinding bit, material can be selectively removed from the work piece edge to create a desired shape and/or surface treatment.

Because the grinding process generates both heat and grinding debris, a fluid such as water is typically used to cool and wash the grinding bit. In the typical grinder design, a sponge is situated to continually irrigate the grinding bit with the fluid. A reservoir of irrigation fluid is situated below the work piece platform, in a tank or tray. The lower end of the sponge is in contact with the irrigation fluid and draws it upwardly to the grinding bit. In other grinder designs, a spray nozzle is situated to disperse irrigation fluid onto the grinding bit, and a pump is used to draw the fluid from the reservoir. After application of the irrigation fluid to the grinding bit, the fluid is collected and returned to the reservoir via a plurality of passageways formed in the work piece platform. In particular, the work piece platform is commonly constructed as a lattice grating that freely passes the irrigation fluid below the grating to the tank or tray that holds the irrigation fluid.

There are several problems associated with the use of irrigation fluids to aid the grinding operation. First, the fluid tends to spray outwardly from the grinding bit in a radial direction, particularly away from the back side of the grinding bit that is not in contact with the work piece. Second, the grinding debris combines with the irrigation fluid to form a sludge that collects on the surface of the grinding bit, thereby reducing its effectiveness as a grinding tool.

To address the spray control problem, splash guards have been proposed that contain the fluid spray within a limited area. According to one design, the splash guard comprises a folding screen made from plastic-coated cardboard or the like that is stood upright behind the grinding apparatus on a table or other surface. The screen is about the size of a conventional three-ring notebook binder and has two or more panels that can be unfolded into the operational position. The primary disadvantage of this type of splash guard is that the fluid it catches has nowhere to go except downwardly onto the surface that supports the screen. This requires messy clean up of the accumulated fluid. Moreover, the screen can block a large work piece as it is being maneuvered around the grinding bit. According to another design, the splash guard comprises a rubber strip member that fits onto a vertical peg located behind the grinding bit on the work piece platform. When mounted on the peg, the strip rises about an inch above the work piece platform and extends horizontally and forwardly from each side of the peg for several inches. The strip thus forms, generally speaking, a "V" shape when viewed in plan. Although this type of splash guard is situated so that the fluid it catches will be returned to the fluid reservoir, the guard is not tall enough vertically or wide enough horizontally to catch much fluid. Moreover, when the guard is contacted by a large work piece being maneuvered around the grinding bit, a portion of the guard will bend rearwardly (when viewed in plan) so as to give way to the work piece. This has the effect of temporarily reducing the amount of the splash protection during the time that the guard is displaced.

To address the sludge removal problem, the sponge used to irrigate the grinding bit is positioned so that its upper end applies contacting pressure against the bit. This has the effect of wiping sludge from the grinding bit as the fluid is applied. However, the sponge quickly becomes clogged with sludge, which not only prevents it from effectively removing additional sludge, but also clogs the fluid passageways of the sponge such that the flow of irrigation fluid to the grinding bit is reduced. Frequent sponge cleaning and/or replacement are thus required. Moreover, the sponge is not able to completely remove sludge from all of the interstitial cracks and crevices that lie between the abrasive particles on the grinding bit surface. The interstitial sludge will build up until it appears to the naked eye that the grinding bit is worn down to an overly smooth condition. This can result in premature replacement of the grinding bit when in fact the bit actually has sufficient grinding capacity that could be realized if the sludge were removed.

Accordingly, there is presently a need for improvement in the way that irrigation fluids are handled in grinding apparatus. What is required in particular is a grinding apparatus design wherein irrigation fluid spray is effectively contained and returned to a source location without messy clean up, and wherein the effective removal of grinding bit sludge is achieved.

SUMMARY OF THE INVENTION

The foregoing problems are solved and an advance in the art is provided by a novel grinding apparatus that includes an improved splash protector and fluid applicator. The grinding apparatus is configured with a base and a support grid mounted on the base to carry a work piece for grinding. A fluid holder is disposed below the support grid. A drive shaft is provided for rotating a grinding bit above the support grid and a power source rotates the drive shaft. The fluid applicator is uniquely constructed to apply irrigation fluid to a grinding bit mounted on the drive shaft without substantial clogging. The splash protector is adapted to connect to the grinding apparatus at a location which is adjacent to the drive shaft. The splash protector efficiently traps irrigation fluid and grinding debris sludge that are spun off from the grinding bit as it is rotated during grinding operations, and returns this material back to the fluid holder. Advantageously, the splash protector is configured so that it maintains its effectiveness even as work piece passes rearwardly by the splash protector during grinding operations.

In exemplary embodiments of the invention, the splash protector is configured so that a lower edge thereof will be in contact with or closely spaced from the support grid when the splash protector is operatively mounted on the grinding apparatus. The upper edge of the splash protector is positioned at or above the highest point of a grinding bit working portion. The splash protector can also be configured with a lateral dimension that allows it to substantially span the support grid in a lateral direction.

The splash protector is also constructed so that its lower edge deflects when contacted by a work piece undergoing grinding, thereby allowing the work piece to pass by the splash protector without hindrance while maintaining effective splash protection. To that end, the splash protector can be formed with a curtain member that is suspended from a supporting channel member. The channel member is relatively rigid so that overall shape of the splash protector (when viewed in plan) is maintained during grinding operations. The curtain can be formed with one or more drape elements selected from the group consisting of fibers, bristles, strips of defined width, and sheet material. The lower edge of the curtain is work piece conformable, meaning that it will deflect when contacted by a work piece yet sufficiently conform itself to the work piece's shape to remain in contact therewith and to thereby maintain effective splash protection.

The grinding apparatus may further include a support column adapted to mount the splash protector to the support grid. In exemplary embodiments of the invention, the support column includes a clip adapted to removably mount the splash protector, and at least one post for engaging the support grid. The post can be provided by one or more detachable mounting adaptors that are selectively mountable to the support column. The mounting adaptors allow the support column to be selectively used with plural grinding apparatus of different design.

The grinding apparatus may further include an eye shield, and optionally an eye shield holder and a support column extension piece. Additionally, the grinding apparatus may include a secondary support grid adapted to mount on the primary support grid. The secondary support grid is adapted to receive a work piece for high-detail grinding against a secondary grinding bit. The splash protector mounting clip is then preferably arranged so that the splash protector can be raised to the level of the secondary support grid.

The fluid applicator can be implemented as a fluid transfer brush comprising plural fibers or bristles adapted to wick irrigation fluid from the fluid holder into contact with a grinding bit mounted on the drive shaft. The fluid applicator further includes a brush holder adapted to secure the brush fibers or bristles and a brush housing for mounting the brush.

The invention further contemplates a splash protector kit for use with a grinding apparatus. The kit includes a splash protector, a support column, a first connector adapted to connect the splash protector to the support column, and a second connector adapted to connect the support column to a grinding apparatus so that the splash protector is adjacent to a grinding bit on the grinding apparatus. The first connector can be implemented as a clip formed on or connected to the support column. The second connector can be implemented with at least one post extending from the support column and adapted to be received by a grinding apparatus support grid. The post can be part of a mounting adaptor that is detachably mountable to the support column. The splash protector kit may include plural mounting adaptors of different configuration for selectively mounting the support column to plural grinding apparatus of different design.

The splash protector kit may further include an eye shield and optionally an eye shield holder and a support column extension piece. The first connector that connects to the splash protector may also be arranged in a manner that allows the splash protector to be raised up for use with a grinding apparatus having a secondary support grid and a secondary grinding bit for high-detail grinding of a work piece.

The invention further contemplates a method for using a grinding apparatus. The grinding apparatus has a base, an apertured support grid mounted on the base, a fluid holder disposed below the support grid, a rotatable grinding bit having a working portion extending above the support grid, a power source for rotating the grinding bit, and a fluid applicator for applying irrigation fluid to the grinding bit. The method includes the steps of connecting a splash protector with a work piece conformable lower edge to the grinding apparatus so that the splash protector is positioned adjacent to the grinding bit, rotating the grinding bit at operational speed, placing a work piece on the support grid, grinding the work piece using the grinding bit while irrigation fluid is applied via the fluid applicator, and using the splash protector to trap irrigation fluid and grinding debris sludge that are spun off from the grinding bit as it rotates while directing the irrigation fluid via the splash protector back to the fluid holder.

BRIEF DESCRIPTION OF THE DRAWINGS

The foregoing and other features and advantages of the invention will be apparent from the following more particular description of preferred embodiments of the invention, as illustrated in the accompanying Drawings in which.

DETAILED DESCRIPTION OF PREFERRED EMBODIMENTS

Figure 1:
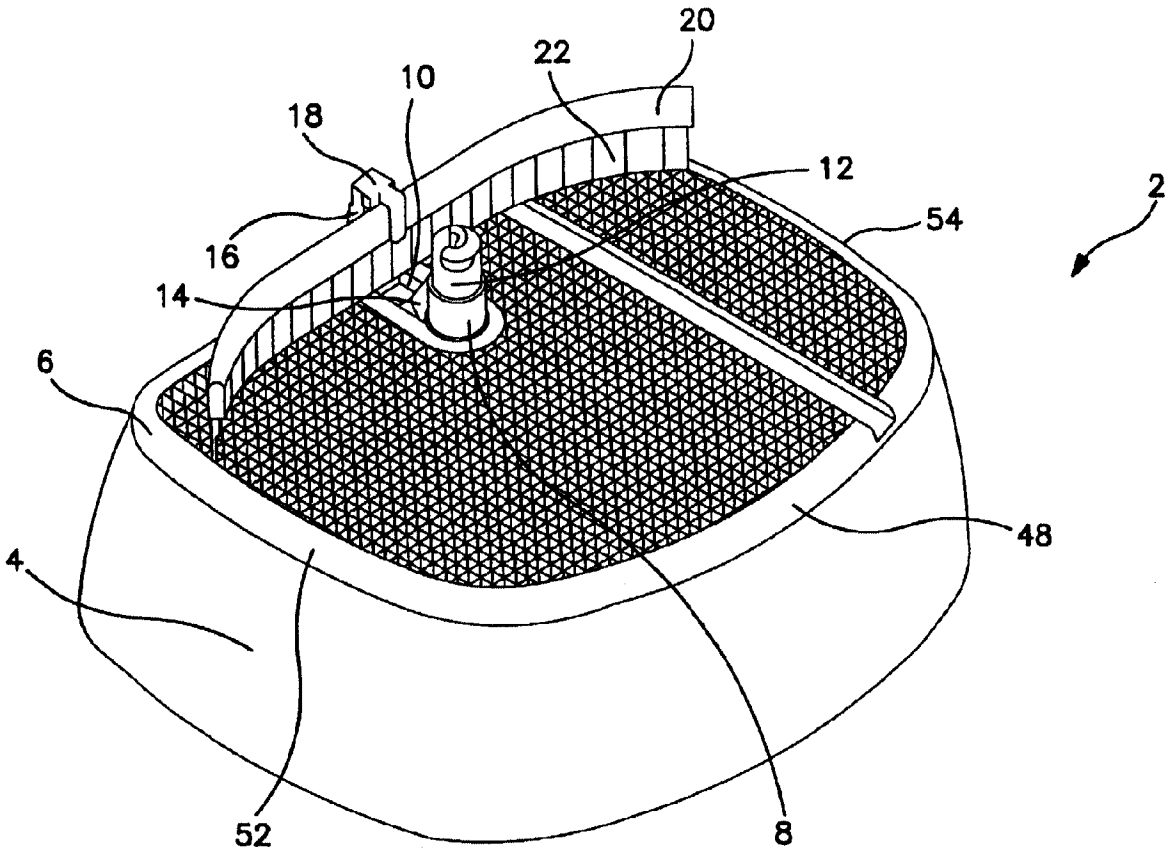
FIG. 1 is perspective view of a grinding apparatus constructed in accordance with the present invention.

Turning now to the Drawings, wherein like reference numerals signify like elements in all of the several views, FIG. 1 illustrates a grinding apparatus 2 that embodies one possible implementation of the invention disclosed herein. The grinding apparatus 2 is shown to include a generally rectangular base 4, upon which is seated a horizontal work table configured as a work piece support grid 6. As described in more detail below, the support grid 6 is formed as a lattice structure that provides a support surface for a work piece (not shown) during grinding operations while freely passing irrigation fluid through plural apertures formed in the grid. A grinding bit 8 extends above a keyhole-shaped opening 10 in the support grid 6 for grinding a work piece. As described in more detail below, the grinding bit 8 is preferably configured as a sleeve that is removably secured to a locking mechanism 12 that is, in turn, secured to a rotating drive shaft (see below). This is the configuration shown in FIG. 1. Alternatively, the grinding bit 8 can be formed as a solid cylindrical member that mounts directly to the drive shaft. Situated immediately behind the grinding bit 8, and extending at an angle through the opening 10, is a partially visible fluid applicator assembly 14. Behind the fluid applicator 14 is a sludge collecting splash protector 16 that is carried on a splash protector support column 18. The splash protector 16 is shown to include an upper horizontal channel member 20. Suspended from the channel member 20 is a drape or curtain 22 that is preferably formed from one or more hanging elements, such as brush fibers or bristles, plural strips of defined width, or even a single sheet (as described in more detail below). As described in more detail below, the lower edge of the curtain 22 is work piece conformable for improved splash protection.

Figure 2:
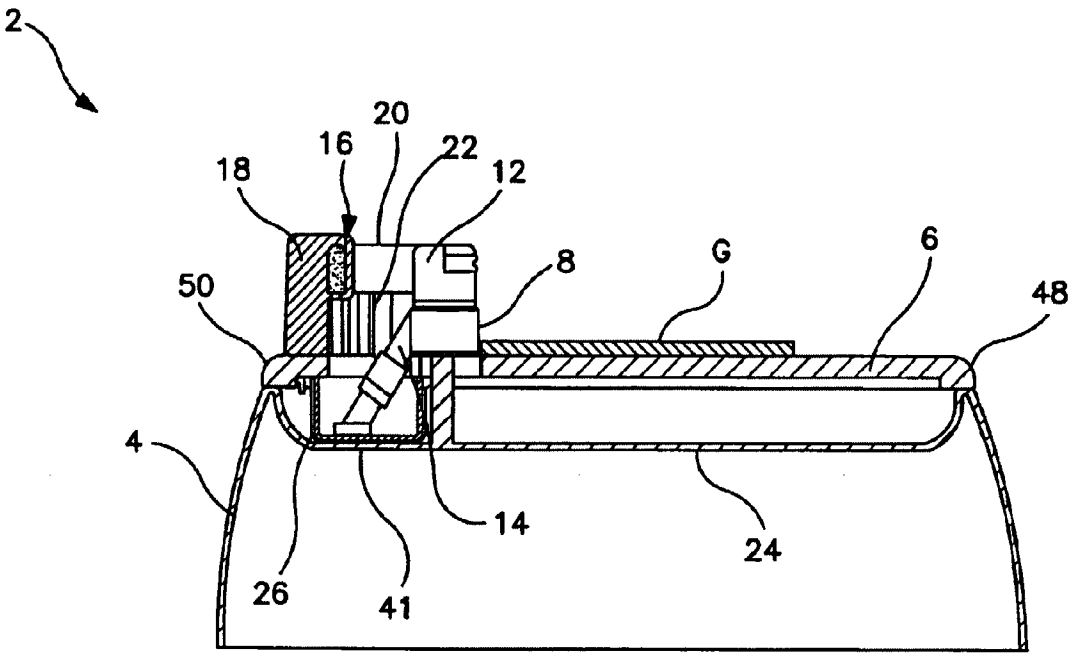
FIG. 2 is a cross-sectional centerline view of the grinding apparatus of FIG. 1.

With additional reference now to FIGS. 2 and 3, a shallow fluid tray 24 is disposed below the support grid 6 and provides a reservoir for holding a quantity of irrigation fluid for cooling and cleaning the grinding bit 8. The irrigation fluid will typically be water, but other liquids could also be used, such as alcohols, ketones, acidic liquids, and basic liquids. If the base 4 is made as a molded article (e.g., from plastic or the like), the fluid tray 24 can be integrally formed with the base, as shown in FIG. 2. Alternatively, the fluid tray 24 could be a separately attached component. If desired, a second fluid tray 26 can be provided below the fluid applicator 14. The second fluid tray 26 provides a separate fluid reservoir that holds a quantity of clean, sludge-free irrigation fluid 28 (labeled "Coolant" in FIG. 3). The second fluid tray 26 separates the clean, sludge-free irrigation fluid 28 therein from the remainder of the fluid tray 24, which serves to collect dirty irrigation fluid that spins off the grinding bit and returns to the fluid tray through the support grid 6. In this way, the dirty fluid, which carries grinding debris as a sludge or slurry, will not be mixed with the clean fluid.

Figure 3:
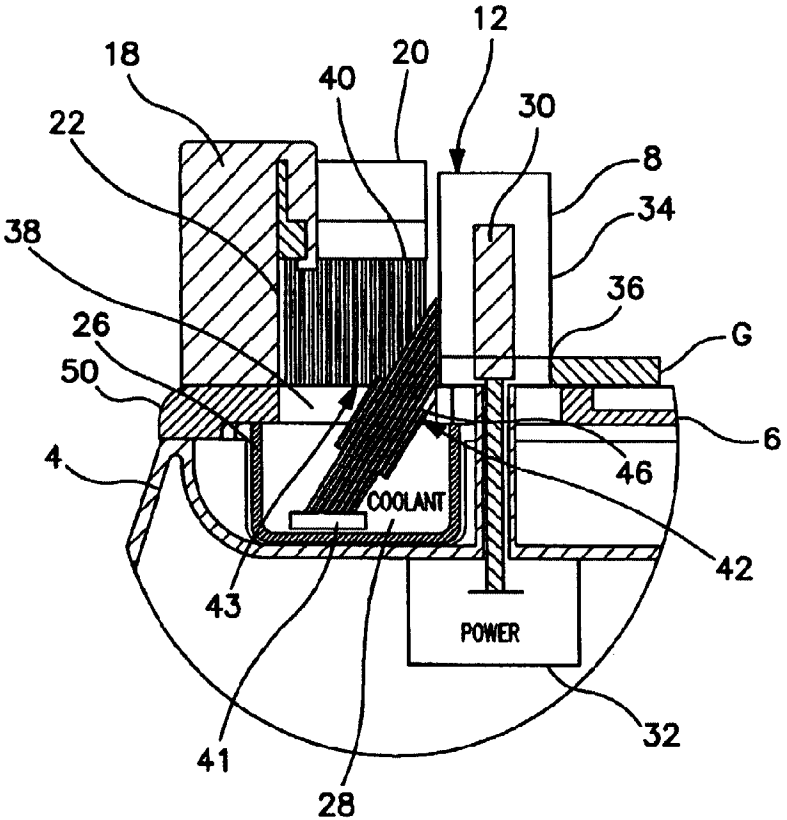
FIG. 3 is an enlarged cross-sectional view showing a detail of FIG. 2.

As best shown in FIG. 3, the grinding bit locking mechanism 12 is secured on a rotatable drive shaft 30 that extends vertically upwardly from below the fluid tray 24. The drive shaft is connected for high speed rotation to a power source 32 that is the prime mover for the drive shaft. The power source 32 can be implemented as an electric motor situated below the drive shaft 30. Alternatively, the power source 32 could be a coupling, such as a conventional pulley, that connects to an electric motor situated at some other location on the grinding apparatus 2. A drive belt or other conventional power transfer means (not shown) would deliver power from the motor to the coupling. The locking mechanism 12 can be provided by any suitable quick-disconnect grinding bit holder that is capable of locking to the drive shaft 28, and which includes an adjustable mandrel for receiving and locking a sleeve-type grinding bit, such as the grinding bit 8, in position. One such locking mechanism is shown and described in commonly assigned U.S. Pat. No. 6,241,589, entitled "Quick Change Bit Holder," whose contents are incorporated herein by this reference. Preferably, the locking mechanism 12 is sized and configured so that the lower edge of the grinding bit 8 will be flush with (or below) the top of the support grid 6. The remainder of the grinding bit 8 will then present a vertical grinding surface 34 that extends above the support grid 6. This will ensure that the edge of a work piece "G" can be brought into full contact with a working portion 36 of the grinding surface 34 when the work piece is resting on the support grid 6 during grinding operations. The working portion 36 is the section of the grinding surface 34 that engages the work piece "G."

Figure 4:
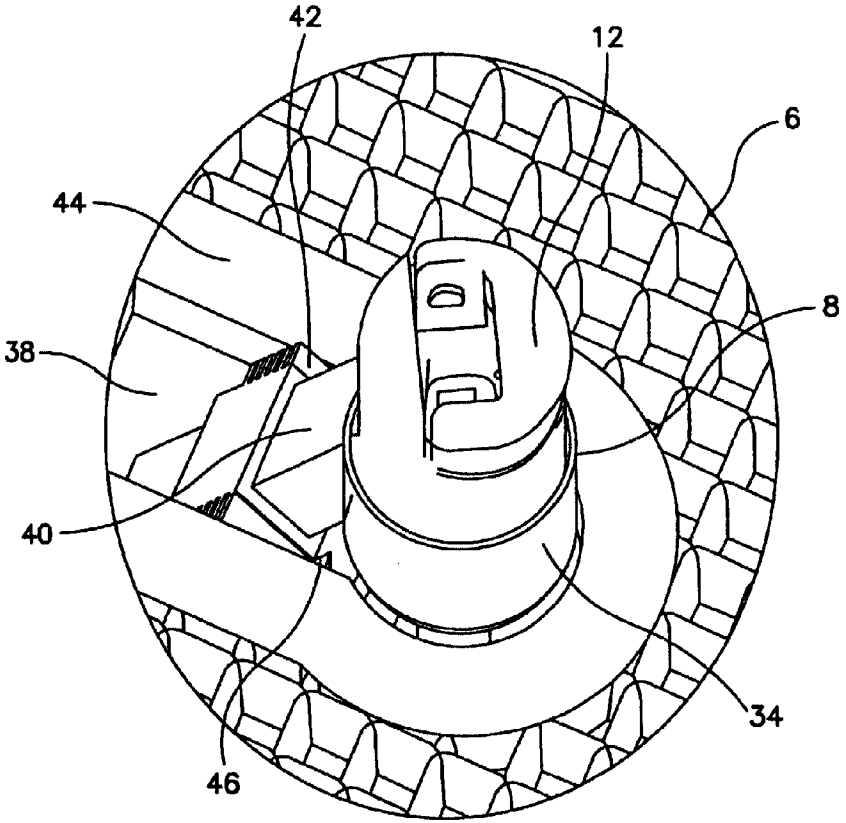
FIG. 4 is a detailed perspective view showing a grinding bit fluid applicator in accordance with the invention.

Continuing now with reference to FIGS. 2 and 3, it will be seen that the fluid applicator assembly 14 extends upwardly from the fluid tray 26 through a cleaner aperture 38 formed by a rectangular base portion of the keyhole-shaped opening 10. The cleaner aperture 38 is situated above the fluid tray 26. The fluid applicator assembly 14 includes a fluid transfer brush 40 having a brush holder 41, and as best shown in FIG. 4, a brush housing 42. The fluid transfer brush 40 includes a collection of parallel fibers or bristles that are captured in the holder 41 to form into a tight bundle at the lower end of the brush. The fibers or bristles can be made of any type of material that can generate a wicking process and remove sludge that is generated by the grinding process from the grinding bit 8. All wicking fabrics rely on capillary action within the fibers. Capillary action (wicking in the truest sense) will attract water from locations where it is abundant and transport it to areas where it is less abundant. Most are made from some form of polyester, the only major exception being polypropylene. Some are microfibers. Microfibers are not a fiber unto themselves, but for present purposes they will be defined as fibers. In a most preferred construction, the fibers or bristles that form the fluid transfer brush 40 comprise a set of hollow polyester tubules. Such tubules are manufactured by Specialty Filaments, Inc. of Andover, Mass., and are available from Felton Brush Company of Londonderry, N.H.

The brush holder 41 can be implemented using any suitable ferrule structure or the like that gathers the fibers or bristles of the fluid transfer brush 40 into a tight bundle. By way of example only, the brush holder 41 can be made by bundling the fibers or bristles that comprise the fluid transfer brush 40, applying liquid epoxy to the lower end of the bundle, and then allowing the epoxy to harden. The brush holder 41 is situated so that the lower portion of the fluid transfer brush 40 dips into the irrigation fluid 28 in the source fluid tray 26. As best shown in FIG. 3, the brush holder 41 and the lower portion of the fibers or bristles that comprise the fluid transfer brush 40 are preferably in close proximity with the bottom surface of the fluid tray 26, so as to ensure that the fibers will wick up the irrigation fluid 28. The wicking process will pull the irrigation fluid 28 in the direction of the arrow 43 shown in FIG. 3. The irrigation fluid 28 will thus be drawn into the upper portion of the fluid transfer brush 40, where the terminal ends of the fibers or bristles that comprise the brush are in contact with the grinding surface 34 of the grinding bit 8. The fluid transfer brush 40 thus provides a constant source of the irrigation fluid 28 to the grinding surface 34, which cools the working portion 36. The fibers or bristles that comprise the fluid transfer brush also clean the sludge from the working portion 36 as the grinding bit 8 rotates. Advantageously, unlike a sponge, the brush will not become clogged by the sludge because the wicking force driving the irrigation fluid will tend to flush the sludge from the ends of the fibers or bristles that comprise the brush, keeping the brush relatively clean. Additionally, the fibers or bristles of the fluid transfer brush 40 will last longer than a sponge.

The brush housing 42 surrounds a medial portion of the fluid transfer brush 40 and is configured as a generally rectangular ring structure that can be made from molded plastic or any other suitable material that facilitates mounting of the brush 40. As shown in FIG. 4, the brush housing 42 can be connected to the edge 44 of the cleaner aperture 38 using a suitable attachment scheme. For example, the edge 44 of the cleaner aperture 38 could be formed with a ledge 46 (see FIGS. 3 and 4) that locks to the brush housing 42. To facilitate vertical and/or horizontal adjustment of the fluid applicator assembly 14, multiple attachment points (not shown) could be provided on the edge 44. This will allow the fluid applicator assembly 14 to be moved up and down or backward and forward in relation to the grinding bit 8, thus accommodating variations in grinding bit size. Moreover, fluid applicator assembly 14 can be repositioned as the fibers or bristles of the fluid transfer brush 40 wear down.

It will be appreciated that other configurations and mounting locations may be used for the fluid applicator assembly 14. For example, in lieu of the brush housing 42 situated at a medial location on the fluid transfer brush 40, an alternative brush housing (not shown) could be formed around the brush holder 41 at the lower end of the fluid transfer brush. This brush housing could be mounted to the bottom of the source fluid tray 26. Another alternative would be to provide a small irrigation fluid reservoir (not shown) above the support grid 6, and provide a fluid applicator assembly (not shown) that extends laterally from the fluid reservoir to the grinding bit 8.

As can be seen in FIGS. 1–3, during operation of the grinding apparatus 2, a user stands or sits adjacent to a front edge 48 of the support grid 6 and lays a work piece comprising a glass pane "G" on the support grid. With the grinding bit 8 rotating at operational speed, the work piece "G" is advanced until an edge thereof engages the bit. The working portion 36 of the grinding bit 8 will abrade the edge of the work piece "G" and remove material therefrom. The back side of the grinding bit 8 will receive a constant supply of the irrigation fluid 28 from the fluid applicator assembly 14. The irrigation fluid 28 will cool the grinding bit 8 and mix with the grinding debris generated by the grinding process to form a sludge or slurry. It will be appreciated that much of the sludge and irrigation fluid will be spun away from the rotating grinding bit 8 as a result of centrifugal force. Any sludge that remains on the grinding bit 8 will be removed via contact with the fibers or bristles that comprise the fluid applicator assembly 14.

Ideally, the sludge and irrigation fluid material that spins off from the grinding bit will be returned to the fluid tray 24 via the plural apertures in the support grid 6. However, as discussed by way of background above, some of the spun-off material may be propelled with sufficient force to land beyond the perimeter of the support grid 6. This material will not return to the irrigation fluid reservoir, and needs to be cleaned up manually. To minimize the amount of spillage, a fluid capture system is needed. In the grinding apparatus 2, this function is performed by the splash protector 16.

As can be seen in FIGS. 1–3, the splash protector 16 is situated near the back edge 50 of the grinding apparatus, behind the grinding bit 8 and the fluid applicator assembly 14. As briefly described above, the splash protector 16 is formed with an upper channel member 20 carrying a downwardly hanging drape or curtain 22. The channel member 20 is centrally mounted to the splash protector support column 18, which is secured to the support grid 6. The support column 18 is preferably sized so that the lowermost edge of the channel member 20 is situated at or above the highest point of the grinding surface 34 of the grinding bit 8. This will place the curtain 22 at the best height to capture material being laterally spun-off from the grinding bit 8. The splash protector 16 also extends horizontally from the support column 18, and preferably reaches the lateral edges 52 and 54 of the support grid 6 in order to maximize its coverage area (see FIG. 1).

The channel member 20 can be made from metal, plastic, rubber or any other material that is rigid enough to carry the curtain 22. A further desirable construction option is to form the channel member 20 with sufficient flexibility or resilience to allow at least the outboard end portions thereof to be bent forwardly to define the partial "U" shape shown in FIG. 1, or to be manipulated into other configurations, while still being relatively rigid. The curtain 22 extends downwardly from the channel member 20 and has a lower edge portion that is preferably either touching or closely spaced from the support grid 6. It can be formed from any of a variety of structural elements, including but not limited to brush fibers or bristles, plural hanging strips of defined width, or even as a single hanging sheet member. A variety of materials may be used to implement the foregoing elements. For example, if the curtain 22 is formed with brush fibers or bristles, a suitable synthetic fiber material may be used, such as polypropylene plastic or rubber strands. This material has the advantage of being water repellent and clump resistant. A non-synthetic fiber material may also be used, such as broom straw or animal hair. If the curtain 22 is formed with hanging strips or as a single hanging sheet, any suitably flexible sheet material may be used, including but not limited to plastic sheeting, rubber, felt, etc. A pulp product, such as thick paper coated with plastic or wax, could also be used. The curtain 22 can be secured to the channel member 20 in a variety of ways, such as by fastening or crimping (see below), or by embedding the upper edge portion of the curtain within the channel member.

As configured in the manner described above, the splash protector 16 will trap material which is spun off from the grinding bit 8, the bulk of which will be directed toward the rear edge 50 of the support grid 6. The splash protector 16 will divert the captured material downwardly to the apertures in the support grid 6, where it will be returned to the fluid tray 24. It will thus be appreciated that the splash protector 16 offers a significant advantage over conventional splash screens designed to be stood up behind a grinding apparatus, on the same table or surface that supports the grinder.

It should be further understood that the forgoing construction details of the splash protector 16 are set forth by way of example only, and that other constructions would also be possible. For example, instead of the splash protector 16 having a defined channel member 20 and curtain 22, a single sheet of material (not shown) could be used. This material sheet, which could be made from any suitable rigid or semi-rigid material, could be attached directly to the support column 18.

Figure 5:
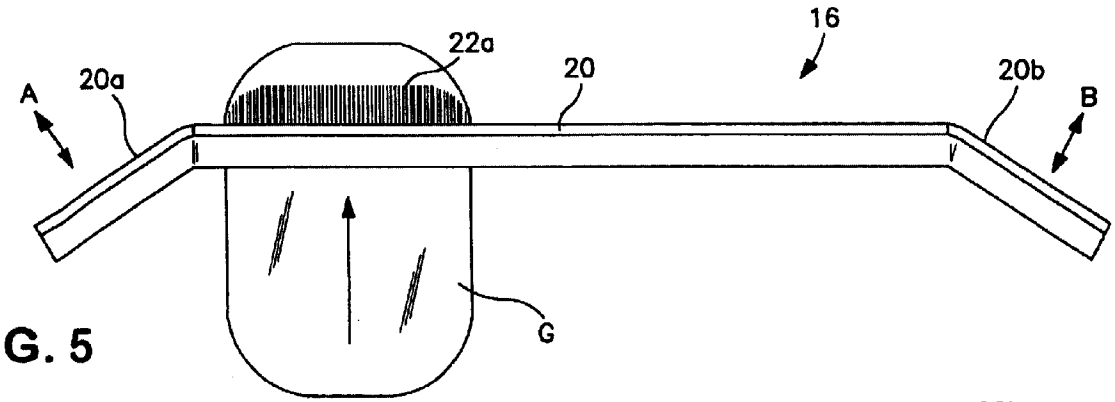
FIG. 5 is a plan view of a splash protector of the grinding apparatus of FIG. 1.
Figure 6:
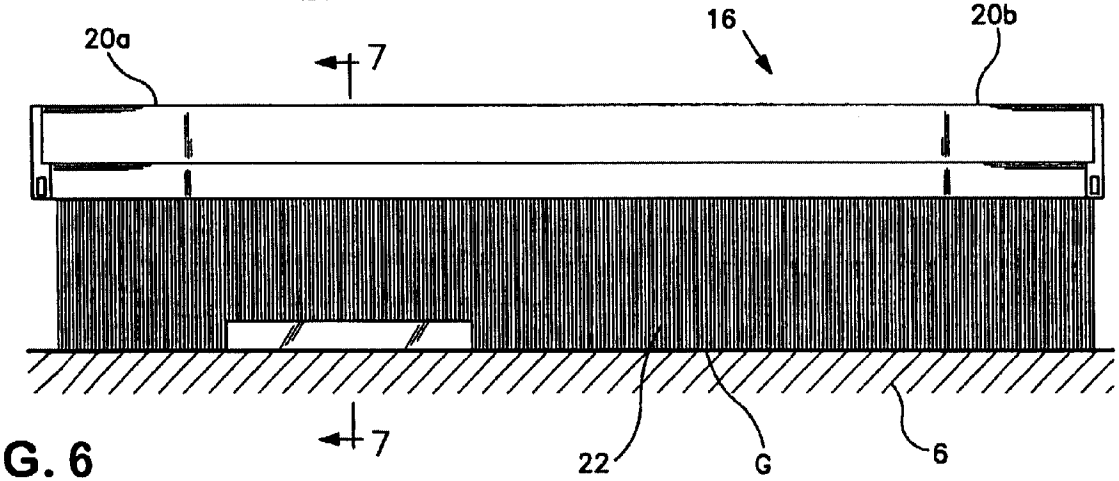
FIG. 6 is a front elevational view of the splash protector of FIG. 5.
Figure 7:
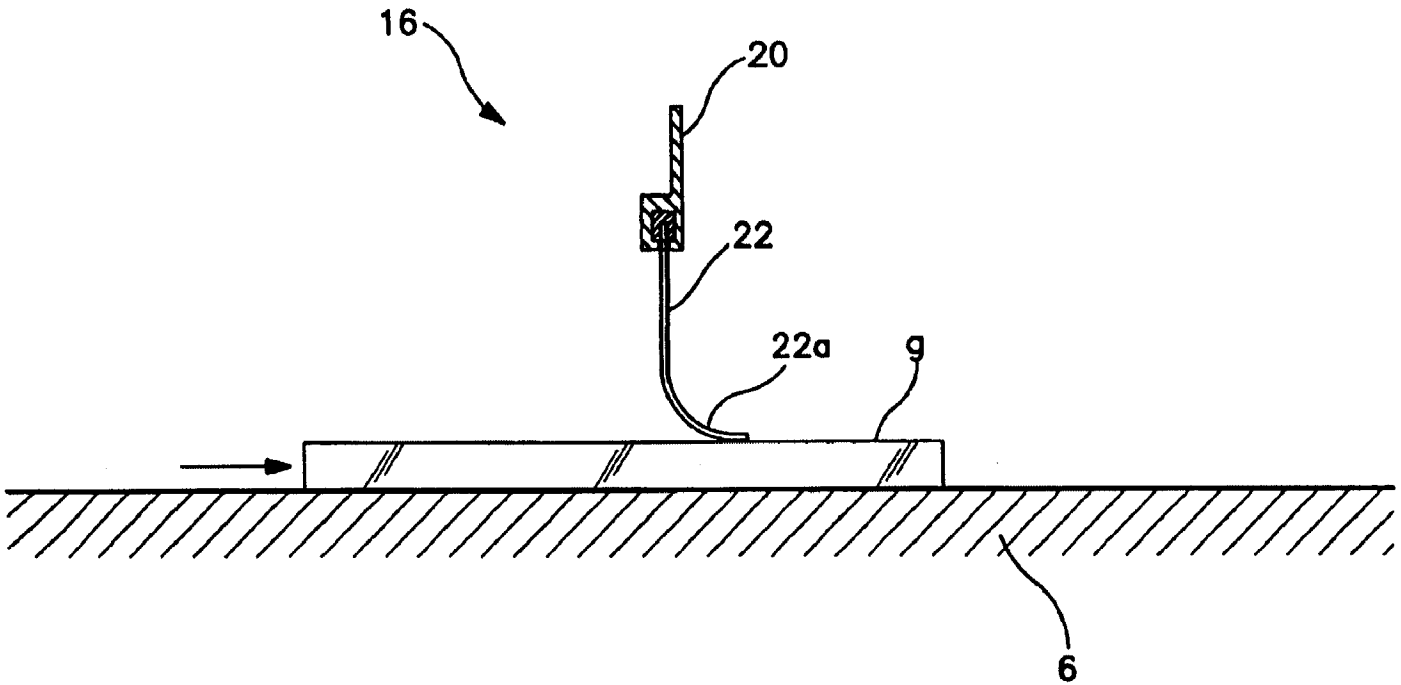
FIG. 7 is a cross-sectional view taken along line 7—7 in FIG. 6.

One advantage of forming the splash protector 16 with the channel member 20 and the hanging curtain 22, is that the lower edge of the curtain 22 is work piece conformable. This means that the curtain 22 will freely accommodate the rearward movement of a large work piece as it is manipulated around the grinding bit 8 and advanced toward the rear edge 50 of the support grid 6. At the same time, the lower edge of the curtain 22 will tend to remain in contacting relationship with the work piece to minimize gaps that could allow fluid to escape past the splash protector 16. This concept is illustrated in FIGS. 5–7. FIG. 5 is a plan view showing a glass work piece "G" being advanced rearwardly through a portion of the curtain 22*a*. FIG. 6 is a front elevational view that shows the curtain 22 extending downwardly from the channel member 20 so that the curtain portion 22*a* is in contacting relationship with the work piece and the remainder of the curtain is in contacting relationship with the support grid 6. FIG. 7 is a cross-sectional view taken along line 7—7 in FIG. 6. This figure shows the rearward movement of the work piece "G" through the curtain 22, with the curtain portion 22*a* being deflected out of the way.

Due to the curtain's flexibility, the curtain portion 22*a* easily deflects to accommodate the work piece "G" while completely surrounding the work piece (see FIG. 6) with fluid barrier protection. Note that FIG. 5 shows how the two end portions 20*a* and 20*b* of the channel member 20 can preferably be flexed in the direction of the arrows "A" and "B," between a substantially linear configuration to the desired partial "U" shape. As indicated, however, the channel member 20 is sufficiently rigid that it will not itself deflect when the splash protector 16 is contacted by the work piece "G." This is in contrast to prior art splash guards made from rubber. As stated by way of background above, rubber splash guards bend upon contact with a work piece and such deflection causes a temporary reduction in fluid barrier effectiveness until the work piece is removed.

Figure 9:
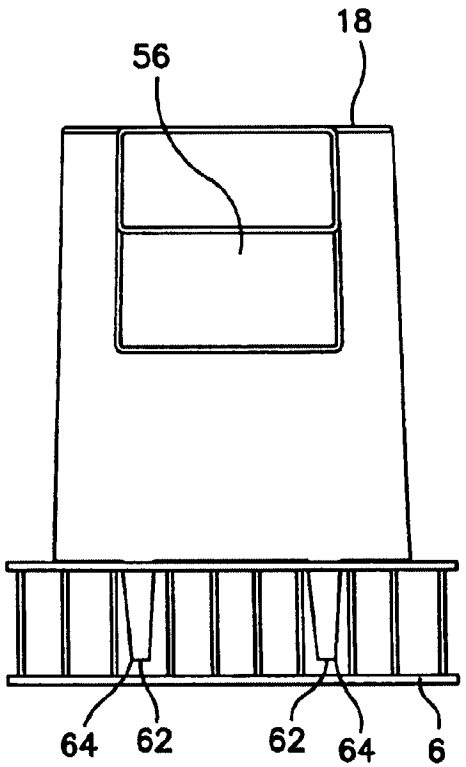
FIG. 9 is a front elevational view of the support column of FIG. 8 seated on a work piece support grid of the grinding apparatus of FIG. 1.
Figure 8:
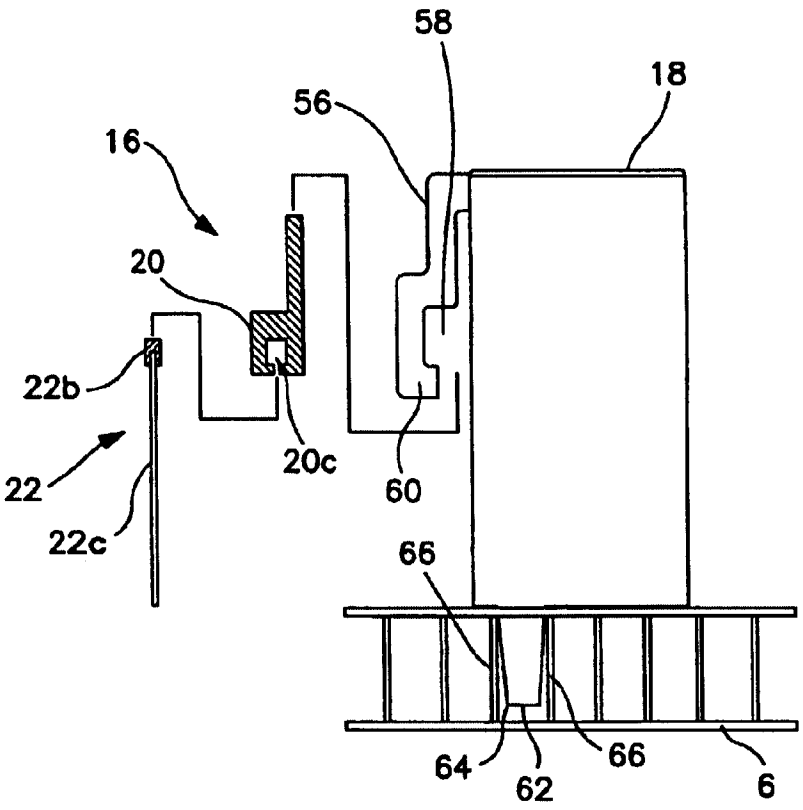
FIG. 8 is partially exploded side elevational view of a splash protector support column carrying the splash protector of FIGS. 5–7 and seated on a work piece support grid of the grinding apparatus of FIG. 1.

Turning now to FIGS. 8 and 9, an exemplary configuration is shown for mounting the curtain 22 to the channel member 20, and for interconnecting the splash protector 16 and the support column 18. In particular, the channel member 20 is shown in FIG. 8 to include a longitudinal channel 20*c* and the curtain 22 is shown to include an upper support clip 22*b* that clamps onto the hanging portion 22*c* of the curtain. The support clip 22*b* feeds into the channel 20*c* in the channel member 20. As previously discussed, the channel member 20 is preferably rigid yet flexible enough to be bent into a desired shape, such as that shown in FIG. 5. This can be accomplished by forming the support clip 22*b* out of a relatively rigid material, such as a flexible metal or plastic, and by forming the channel member 20 out of a very flexible material, such as rubber. In this way, when the support clip 22*b* is disposed within the channel 20*c*, the channel member 20 will be imparted with the desired rigidity.

FIG. 8 also shows the channel member 20 being generally "L" shaped, and the support column 18 is shown to be formed with a clip 56 that defines a matching generally "L" shaped recess 58. To secure the channel member 20 to the support column 18, it can be introduced edgewise into the recess 58 and slid until midpoint of the channel member 20 is adjacent the support column. Alternatively, if the clip 56 is formed to be somewhat flexible, the support column 18 could be introduced from below and pulled upwardly until it snaps into position in the recess 58. Note that a small lip 60 is formed at the lower end of the clip 56 to trap the support column 18 within the recess 58. It will be appreciated that although the channel member 18 and the recess 58 are generally "L" shaped, other shapes and configurations could also be used. Note, however, that the cross-sectional width of the channel member 16 should be relatively small if it is desired to allow bending of the channel member portions 20*a* and 20*b* in the manner shown in FIG. 5.

FIGS. 8 and 9 also show an exemplary configuration for mounting the support column 18 to the support grid 6. In particular, the support column 18 includes a pair of downwardly extending posts 62 that are sized to be received in the apertures of the support grid 6, two of which are shown by reference numeral 64. The posts 62 can be tapered in one or both dimensions (dual tapering is shown in FIGS. 8 and 9) in order to facilitate insertion into the apertures 64. As shown in FIG. 8, the base of each post 62 is preferably sized in at least one direction to snugly engage two opposing grid walls 66 of the support grid 6, thereby maintaining the posts 62 in the desired mounting position.

Figure 11:
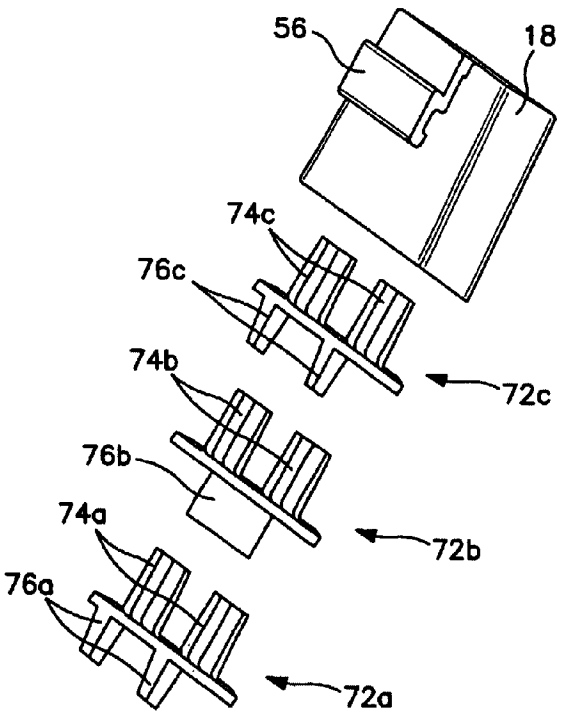
FIG. 11 is an exploded perspective view showing the support column of FIGS. 8–9 and three alternative coupling members for attaching the support column to work piece support grids of different size.
Figure 10:
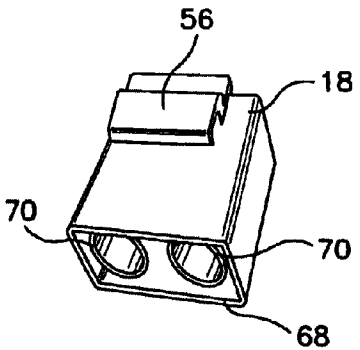
FIG. 10 a perspective view showing a lower portion of the support column of FIGS. 8–9.

It will be appreciated that not all grinding apparatus support grids have grid apertures of that are the same size and shape. Indeed, there is a fair amount of variability among existing commercially available grinders. The present invention accommodates this diversity by constructing the posts 62 as part of a detachable mounting adaptor that can be removed from the support column 18 and replaced when necessary. This concept is shown in FIGS. 10 and 11. FIG. 10 is perspective view showing the support column 18 from the lower base end thereof. As can be seen, the support column is a substantially hollow structure (preferably made of molded plastic) that is defined by a generally "D" shaped peripheral wall 68. Formed within the hollow interior defined by the wall 68 are two tube members that extend upwardly from the support column's base end and define a pair of cylindrical cavities 70. The cylindrical cavities 70 allow the support column 18 to selectively mount a variety of mounting adaptors, three of which are shown by reference numerals 72*a*, 72*b* and 72*c* in FIG. 11. The mounting adaptors 72*a–c* all have respective pairs of upwardly extending mounting elements 74*a*, 74*b* and 74*c* that are sized to be removably received by the cylindrical cavities 70 of the support column 18. The mounting adaptors 72*a–c* also have respective post configurations 76*a*, 76*b* and 76*c* that are designed to mount to specific grinding apparatus support grids. For example, the post configuration 76*a* of the mounting adaptor 72*a* could provide the two posts 62 of FIGS. 8 and 9. The post configuration 76*b* of the mounting adaptor 72*b* provides a single large post for another type of support grid. The post configuration 76*c* of the mounting adaptor 72*c* provides two posts that are smaller in size than the posts 62 of FIGS. 8 and 9. In will be appreciated that many other mounting adaptors could also be used with the support column 18.

Figure 13:
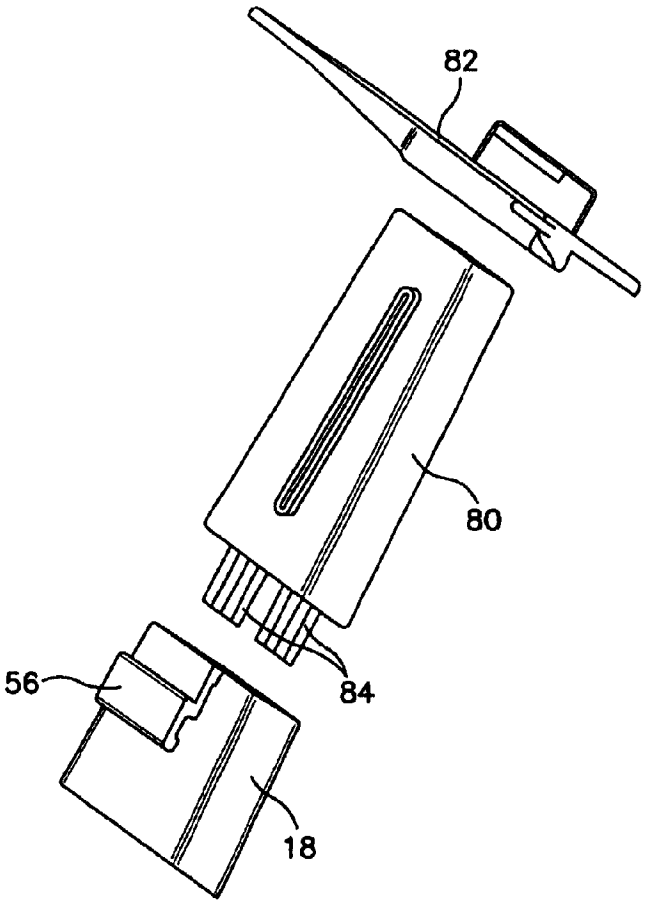
FIG. 13 is an exploded perspective view showing the support column of FIGS. 8–9 mounting a support column upper extension piece and an eye shield holder.
Figure 12:
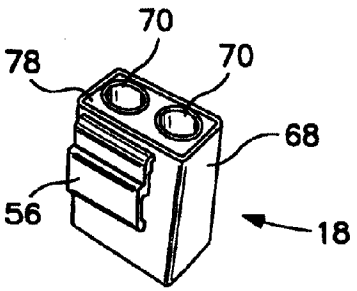
FIG. 12 is a perspective view showing an upper portion of the support column of FIGS. 8–9.
Figure 14:
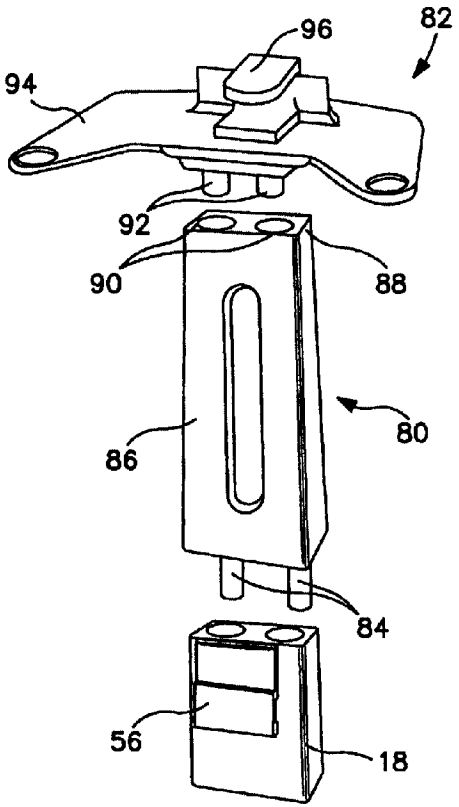
FIG. 14 is another exploded perspective view showing the support column of FIGS. 8–9 mounting a support column upper extension piece and an eye shield holder.

Turning now to FIGS. 12 and 13, an additional optional feature that can be provided by the invention is the ability to add an extension to the support column 18 for the purpose of mounting a eye shield to the grinding apparatus 2. FIG. 12 is a perspective view showing the upper end of the support column 18. It shows the peripheral wall 68 terminating at a generally planar upper surface 78, which is apertured to provide access to the cylindrical cavities 70. FIG. 13 is an exploded perspective view showing the support column 18 in combination with a support column upper extension piece 80 and an eye shield holder 82. Both components can be made from molded plastic or other suitable material. The base end of the extension piece 80 includes a pair of mouting posts 84 that are sized to be removably received in the support column's cylindrical cavities 70. The upper end of the extension piece 80 is configured to mount the eye shield holder 82. In particular, as shown in FIG. 14, the extension piece 80 is formed with a peripheral wall 86 whose upper end is capped with a generally planar upper surface 88. The upper surface 88 is apertured to provide access to a pair of cylindrical cavities 90 formed within the interior defined by the peripheral wall 86 (by way of tube members or the like). The cylindrical cavities 90 are sized to removably receive a pair of post members 92 formed on the base of the eye shield holder 82. Alternatively, the extension piece 80 could be permanently mounted to the eye shield holder 82.

As can be further seen in FIG. 14, the eye shield holder 82 includes a generally planar carrier surface 94 designed to support an eye shield, and a clip member 96 that secures the eye shield to the carrier surface.

Figure 16:
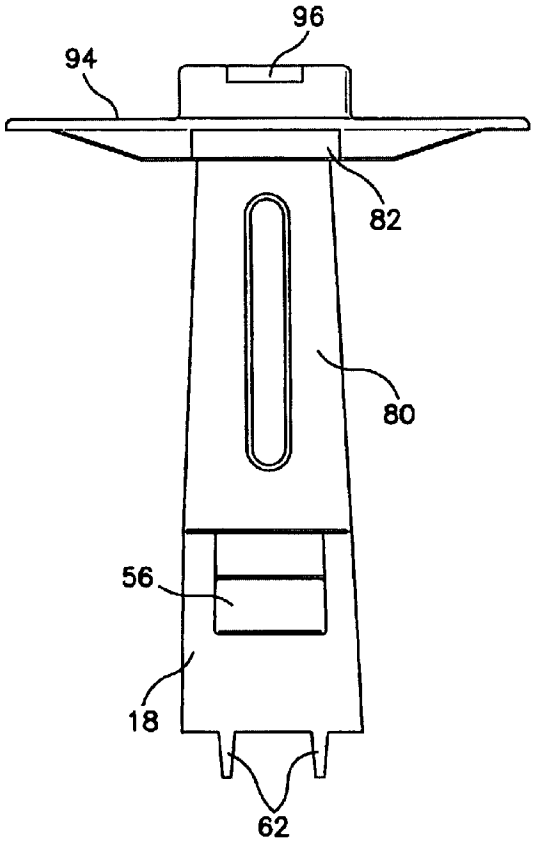
FIG. 16 is a front elevational view showing the support column of FIGS. 8–9 mounting an upper extension piece and an eye shield holder.
Figure 15:
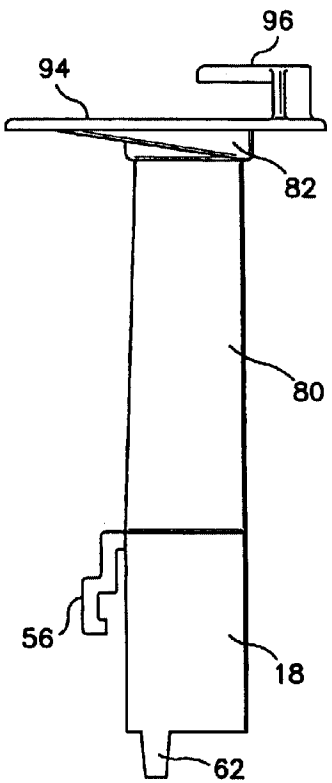
FIG. 15 is side elevational view showing the support column of FIGS. 8–9 mounting an upper extension piece and an eye shield holder.

FIGS. 15 and 16 show the support column 18, the extension piece 80 and the eye shield holder 82 in their fully nested operational configuration. It will be seen that the support column 18 and the extension piece 80 may be formed with a slightly tapering vertical profile, and that the base end of the extension piece is matched in cross-sectional size to the upper end of the support column to provide a smooth transition. These design features will impart an eye pleasing appearance to the component combination. Many other configurations could also be used.

Figure 17:
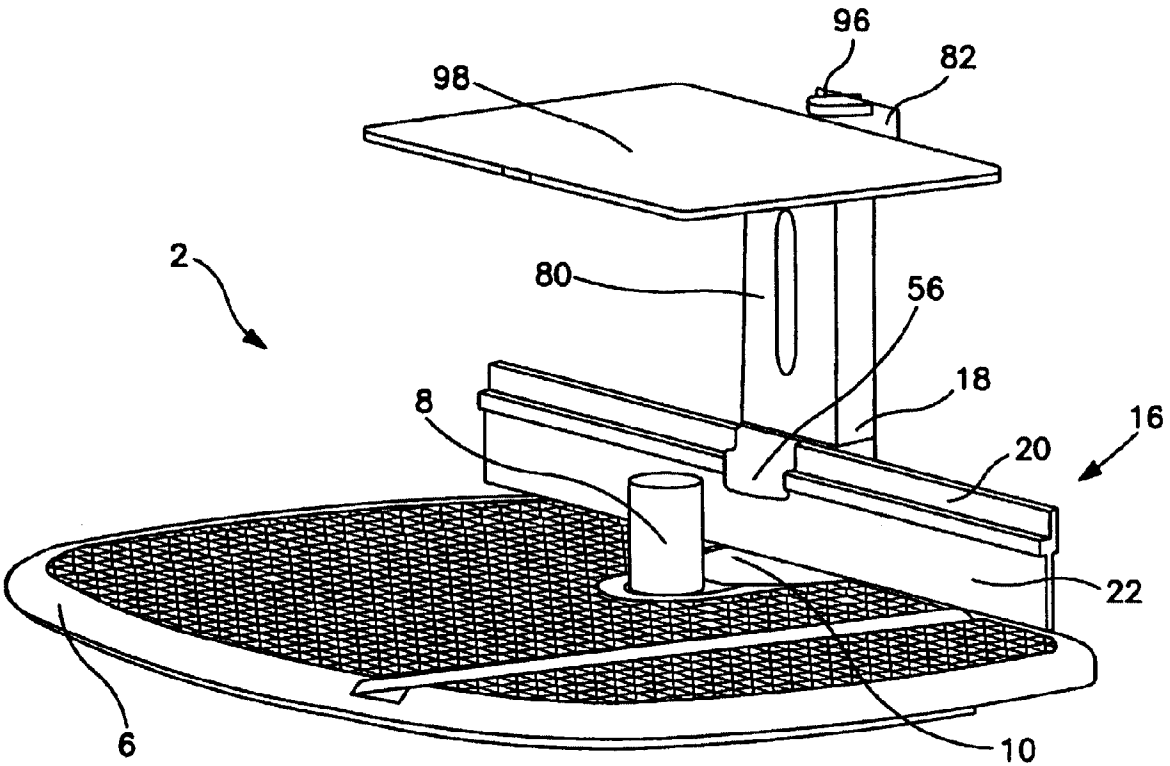
FIG. 17 is a perspective view of a work piece support grid of the grinding apparatus of FIG. 1 mounting the splash protector and the eye shield holder of FIGS. 13–16.

Turning now to FIG. 17, the support column 18, the extension piece 80 and the eye shield holder 82 are shown to be mounted in combination to the support grid 6 of the grinding apparatus 2. An eye shield 98 rests on the eye shield holder's carrier surface 94 (not shown) and is retained by the clip member 96. The eye shield 98 can be made from any suitable transparent material, such as clear plastic, that allows a user to view the grinding bit 8 during grinding operations, while preventing irrigation fluid and grinding debris sludge from splashing into the user's face.

Figure 18:
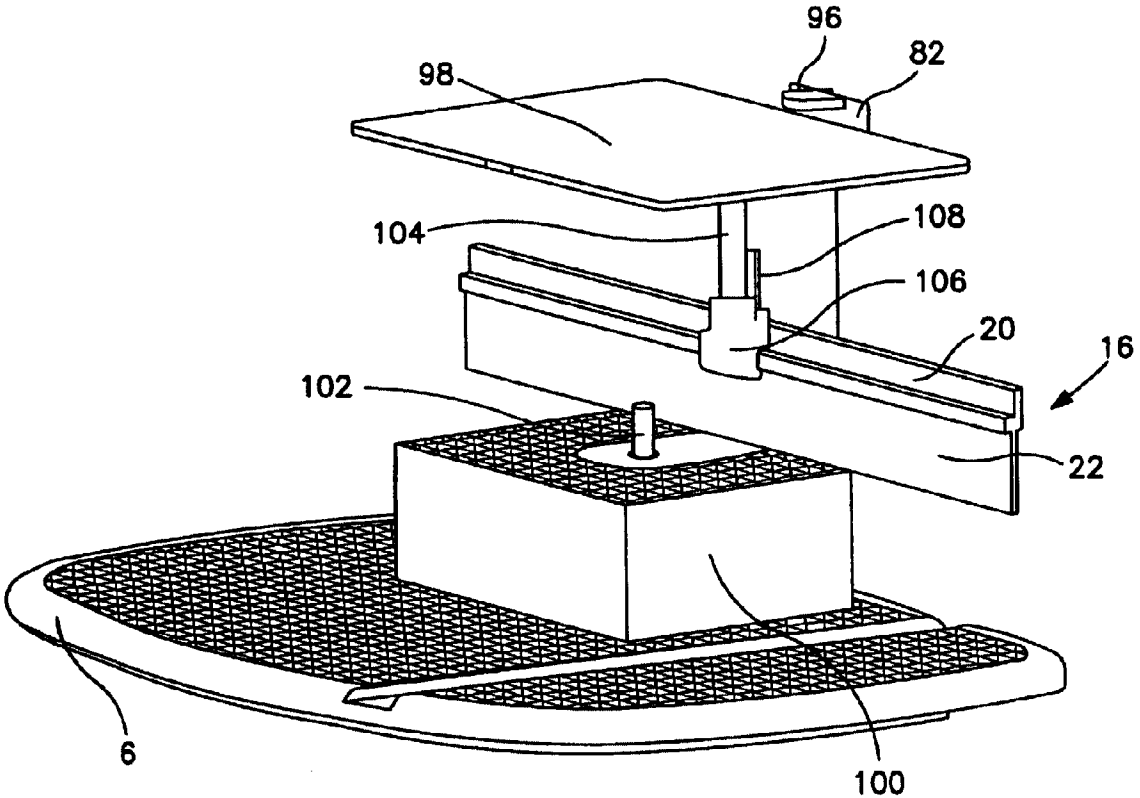
FIG. 18 is a perspective view of a work piece support grid of the grinding apparatus of FIG. 1 mounting the splash protector and the eye shield holder of FIGS. 13–16, with the splash protector being elevated to accommodate a temporary work piece support platform.

FIG. 18 shows a modification of the setup shown in FIG. 17. In this figure, a secondary support grid 100 is placed on top of the primary support grid 6 and a reduced-diameter secondary grinding bit 102 is used for high-detail grinding of a glass work piece. The modified setup of FIG. 18 also utilizes the splash protector 16, but it will be seen that the splash protector is raised above its normal position so that the lower edge of the curtain 22 contacts or is closely spaced from the secondary support grid 100. There are several ways in which the splash protector 16 could be placed in the elevated position. One way would be to provide a modified version of the support column 18 that is elongated so as to raise the position of the support column's mounting clip 56. A second approach would be to form a splash protector mounting clip on the extension piece 80. A third alternative approach, and the one that is shown in FIG. 18, is to replace the support column 18 and the extension piece 80 with an integrated support column 104 of equal height. Moreover, instead of having the statically positioned splash protector mounting clip 56, a vertically adjustable mounting clip 106 can be slidably retained on a track system 108. The mounting clip 106 may thus be positioned up and down to place the splash protector 16 at any desired height.

Figure 19:
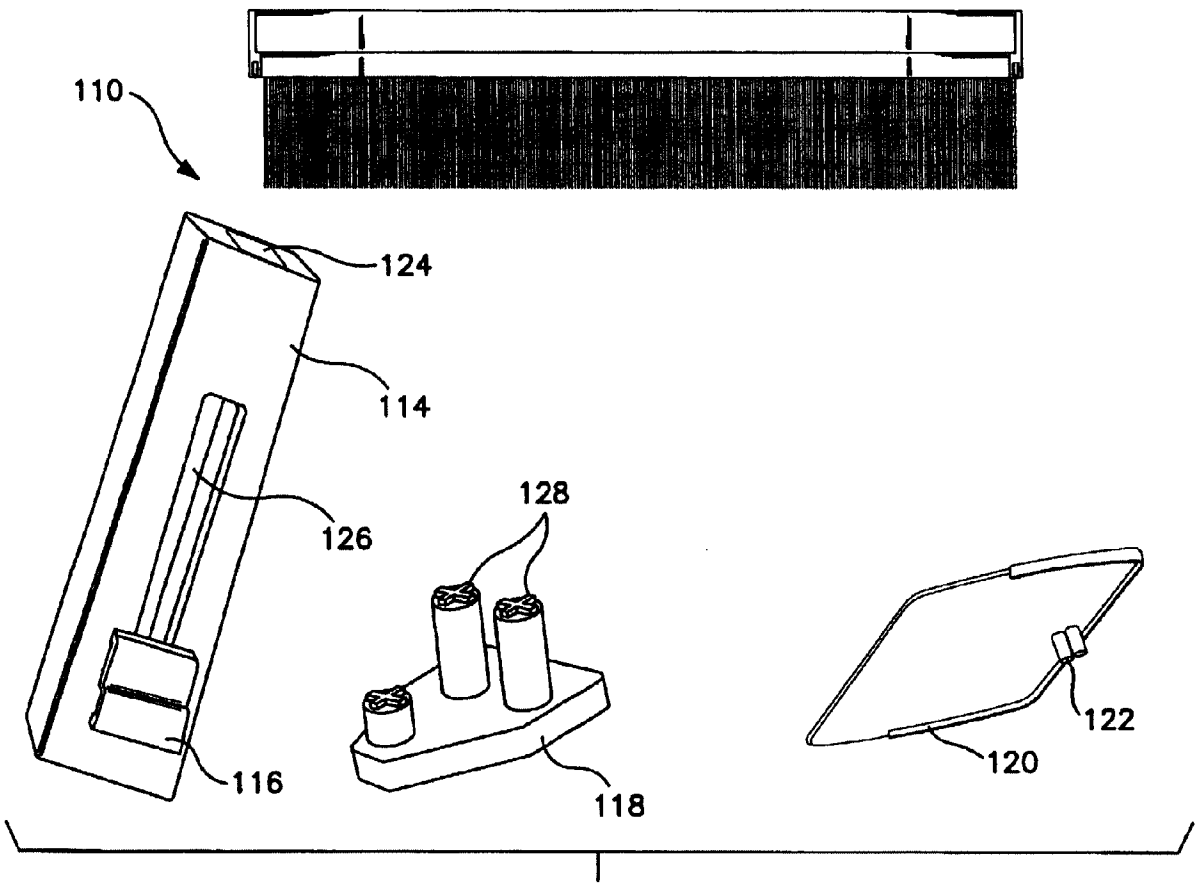
FIG. 19 is a perspective view showing components of a splash protector kit in accordance with the invention.

Accordingly, a grinding apparatus has been disclosed which has an improved splash protector and fluid delivery system. While various embodiments of the invention have been disclosed, it should be apparent that many variations and alternative embodiments could be implemented in accordance with the teachings set forth herein. For example, it will be appreciated that the invention may be further implemented as a splash protector accessory kit for a grinding apparatus. FIG. 19 shows one such exemplary kit 110. The kit 110 contains a splash protector 112, an integrated extended support column 114 having a slideable mounting clip 116, at least one detachable mounting adaptor 118 for mounting the support column to a grinding apparatus, and an eye shield 120. As can be seen, the eye shield 120 includes a post 122 that is adapted to mount to a corresponding aperture 124 formed in the top of the support column 114. As can also be seen, the support column 114 has a longitudinal slot track 126 that carries the mounting clip 116. The mounting clip 116 can be secured at any point along the slot 126 using a suitable locking device, such as a thumbscrew (not shown) positioned on the back side of the support column 114. The detachable mounting adaptor 118 includes two posts 128 that are adapted to mount to corresponding apertures (not shown) formed in the bottom of the support column 114. A second pair of posts (not shown) are provided on the bottom of the mounting adaptor 118 for securing the mounting adaptor to a grinding apparatus support grid. Although not shown, the kit 110 may further include the secondary support grid 100, and possibly the secondary grinding bit 102, of FIG. 18. It will also be seen that the eye shield 120 mounts directly to the support column 114 by way of the post 122, without use of a separate eye shield holder.

Although the post 122 is rigidly attached to the eye shield 120, it would be possible to provide a pivoting assembly between the post and the eye shield. In this way, the eye shield could be pivoted upwardly and rearwardly out of the way to a non-operational position when it is desired to view a work piece directly, or to change a grinding bit, or to perform some other operation on the grinding apparatus.

The invention may also be implemented as a method for using a grinding apparatus. The grinding apparatus is of the type disclosed herein, and has a base, an apertured support grid mounted on the base, a fluid holder disposed below the support grid, a rotatable grinding bit having a working portion extending above the support grid, a power source for rotating the grinding bit, and a fluid applicator (as described above) for applying irrigation fluid to the grinding bit. The method includes the steps of connecting a splash protector (as described above) to the grinding apparatus so that the splash protector is positioning adjacent to the grinding bit, rotating the grinding bit at operational speed, placing a work piece on the support grid, grinding the work piece using the grinding bit while irrigation fluid is applied via the fluid applicator, and using the splash protector to trap irrigation fluid and grinding debris sludge that are spun off from the grinding bit as it rotates while directing the irrigation fluid via the splash protector back to the fluid holder.

Figure 20:
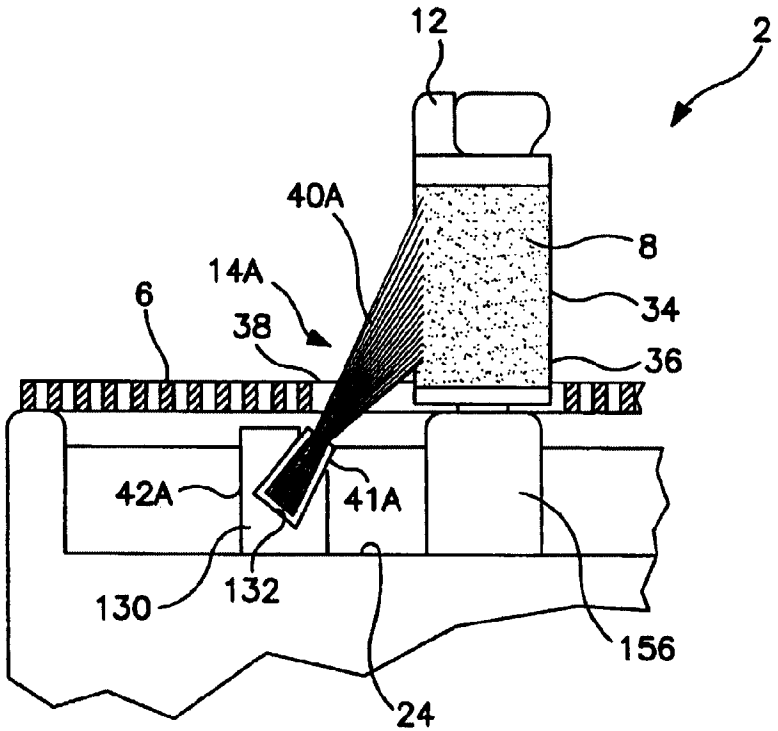
FIG. 20 is a partial cross-sectional view of the grinding apparatus of FIG. 1 showing a modified fluid applicator assembly.
Figure 21:
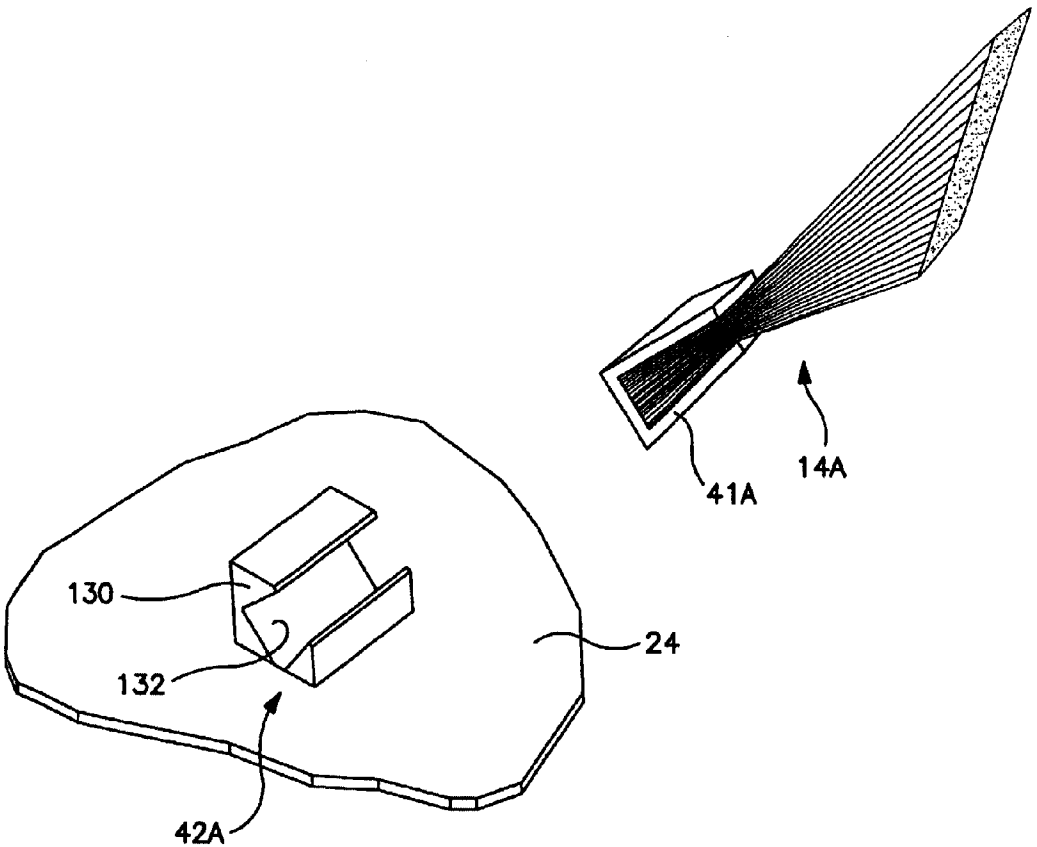
FIG. 21 is a partial perspective view showing the components of the modified fluid applicator assembly of FIG. 20.

As shown in FIGS. 20–23, modifications to the fluid applicator assembly 14 can also be made in accordance with the invention. FIGS. 20 and 21 illustrate a first modification wherein a fluid applicator assembly 14A includes a fluid transfer brush 40A, a brush holder 41A, and a brush housing 42A. The fluid transfer brush 40A includes a collection of parallel fibers or bristles that are captured in the holder 41A to form into a tight bundle at the lower end of the brush. As previously described, the fibers or bristles can be made of any type of material, such as hollow polyester tubules, that can generate a wicking process and remove sludge that is generated by the grinding process from the grinding bit 8.

The brush holder 41A can be implemented using any suitable structure that gathers the fibers or bristles of the fluid transfer brush 40A into a tight bundle. By way of example only, the brush holder 41A can be made as a generally U-shaped clamping element that receives the fibers or bristles which comprise the fluid transfer brush 40A, and which is crimped at its open end to capture the fibers or bristles and constrain them into a bundle. If desired, the ends of the fibers or bristles that comprise the fluid transfer brush 40A could be encased in epoxy or the like before introducing the brush 40A into the brush holder 41A.

The brush housing 42A supports the brush holder 41A of the fluid transfer brush 40A and is configured as an upright pedestal structure 130 that can be made from molded plastic or any other suitable material that facilitates mounting of the brush 40A. The brush housing 42A is disposed within the fluid tray 24 and extends upwardly from a lower surface thereof. As best shown in FIG. 21, the brush housing 42A is formed with a generally U-shaped slot 132 that is sized to slideably receive the brush holder 41A in a direction normal to the plane of FIG. 20. This slideable motion allows the brush holder 41A to be removably mounted on the brush housing 42A to facilitate brush replacement. Note that the slot 132 in the brush housing 42A is angled toward the grinding bit 8 in order to place the brush 40A in its proper operational position. In this position, the lower portion of the fluid transfer brush 40A wicks irrigation fluid from the fluid tray 24 to the upper portion of the fluid transfer brush 40A where the terminal ends of the fibers or bristles that comprise the brush are in contact with the grinding surface 34 of the grinding bit 8.

Figure 22B:
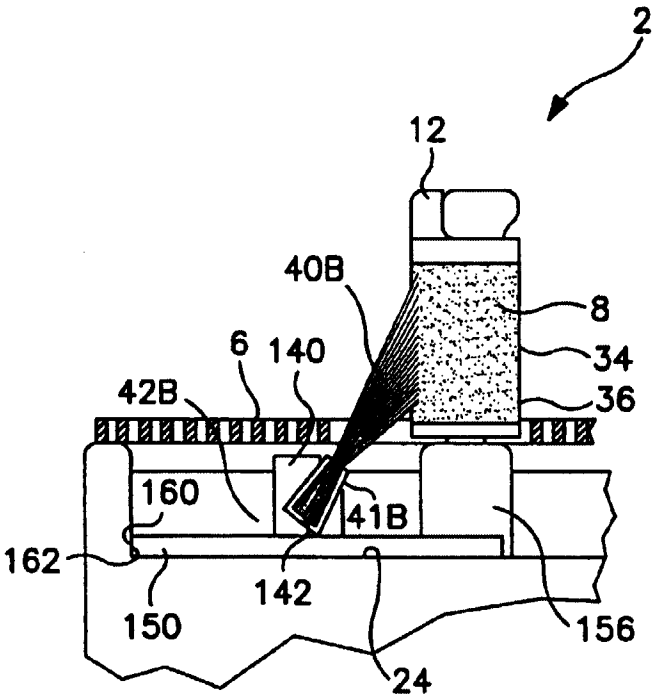
FIGS. 22A and 22B are partial cross-sectional views of the grinding apparatus of FIG. 1 showing another modified fluid applicator assembly as it is being mounted on the grinding apparatus.
Figure 22A:
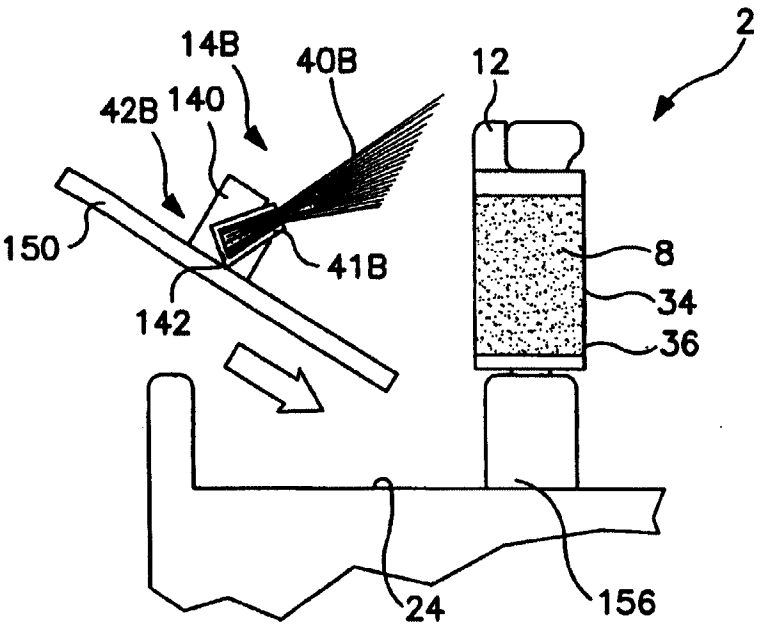
Figure 23:
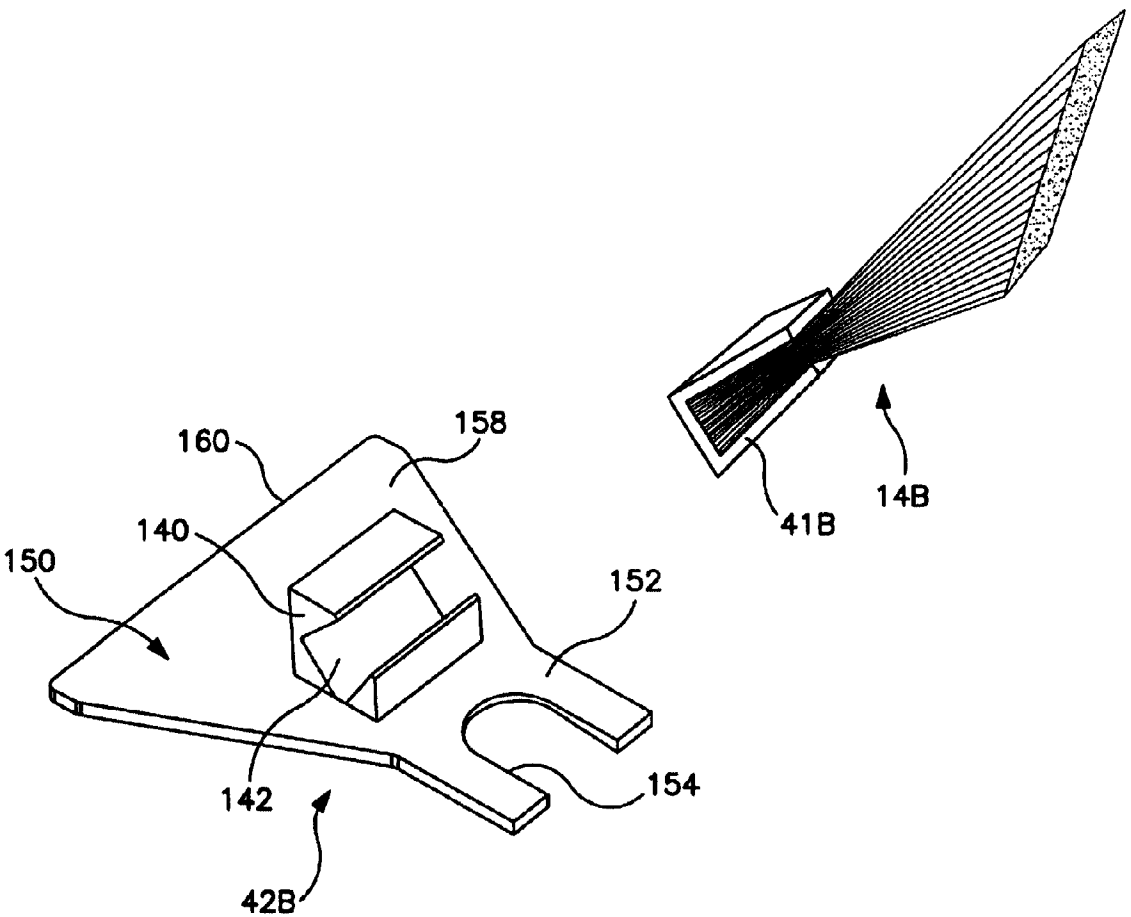
FIG. 23 is an exploded perspective view showing the components of the modified fluid applicator assembly of FIGS. 22A and 22B.

FIGS. 22A, 22B and 23 illustrate a second modification of the fluid applicator assembly 14 wherein a fluid applicator assembly 14B includes a fluid transfer brush 40B, a brush holder 41B, and a brush housing 42B. The fluid applicator assembly 14B is identical in most respects to the fluid applicator assembly 14A of FIGS. 20 and 21, the only difference being that the brush housing 42B includes not only a pedestal 140 with an angled slot 142, but also a mounting base 150 that allows the fluid applicator assembly 14B to be easily inserted in the fluid tray 24, and secured for operation. The insertion of the fluid applicator assembly 14B into the fluid tray 24 is shown in FIGS. 22A and 22B. In the initial position of FIG. 22A, the brush holder 41B carrying the brush 40B is mounted on the brush housing 42B, and the entire assembly is advanced downwardly and to the right. In the operational position of FIG. 22B, the fluid applicator assembly 14B is situated so that the mounting base 142 of the brush housing 42B is resting on the upper surface of the fluid tray 24 (or the optional second fluid tray 26 of FIG. 3). In this position, the fluid applicator assembly 14B is situated so that the lower portion of the fluid transfer brush 40B dips into the irrigation fluid in the fluid tray 24 and the upper portion of the fluid transfer brush 40B is positioned so that the terminal ends of the fibers or bristles that comprise the brush are in contact with the grinding surface 34 of the grinding bit 8.

The mounting base 150 of the brush housing 42B can be formed using any suitable configuration that is compatible with the design of the grinding apparatus 2. By way of example only, as shown in FIG. 23, the end of the mounting base 150 that faces the grinding bit 8 can be formed with a yoke 152 having a central slot 154 therein. The slot 154 is sized to engage a raised post portion 156 of the fluid tray 24. The post 156 is of generally cylindrical shape and is provided to allow the drive shaft that drives the grinding bit 8 to pass through the fluid tray without contacting irrigation fluid. The remainder of the mounting base 150 flares outwardly from the yoke 152 to form a generally triangular portion 158 (or other shape) that carries the pedestal portion 140 of the brush housing 42B. As shown in FIG. 22B, the triangular portion 158 is sized so that the edge 160 thereof which is opposite from the yoke 152 engages a side portion 162 of the fluid tray 24. This arrangement effectively traps the mounting base 150 between the post 156 and the side portion 162, thereby retaining it in position during operation of the grinding apparatus 2. Note that although FIG. 22B shows the mounting base 150 being secured to the fluid tray 26, it could also be mounted to other structure, such as the support grid 6.

As in the case of FIGS. 20 and 21, the generally U-shaped slot 142 of the pedestal 140 is sized to slideably receive the brush holder 41B in a direction normal to the plane of FIG. 22B. As shown in FIG. 23, this slideable motion allows the brush holder 41B to be removably mounted on the brush housing 42B to facilitate brush replacement. Note that the slot 142 in the brush housing 42B is angled toward the grinding bit 8 in order to place the brush 40B in its proper position.

In view of the foregoing, it will be understood that the invention is not to be in any way limited except in accordance with the spirit of the appended claims and their equivalents.

I claim:

1. A grinding apparatus, comprising:

a base;

an apertured support grid mounted on said base and adapted to support a work piece for grinding;

a fluid holder disposed below said support grid;

a drive shaft for rotating a grinding bit working portion above said support grid;

a power source for rotating said drive shaft;

a fluid transfer device for transferring irrigation fluid from said fluid holder into contact with a grinding bit mounted on said drive shaft; and a housing supporting said fluid transfer device.

2. A grinding apparatus in accordance with claim 1, wherein said housing removably supports said fluid transfer device.

3. A grinding apparatus in accordance with claim 1, wherein said housing supports said fluid transfer device in said fluid holder.

4. A grinding apparatus in accordance with claim 1, wherein said housing mounts said fluid transfer device to said fluid holder.

5. A grinding apparatus in accordance with claim 1, wherein said housing is in said fluid holder.

6. A grinding apparatus in accordance with claim 1, wherein said housing is removably mounted to said fluid holder.

7. A grinding apparatus in accordance with claim 1, wherein said housing comprises a pedestal extending from a lower surface of said fluid holder.

8. A grinding apparatus in accordance with claim 7, wherein said housing comprises an angled slot in said pedestal to receive said fluid transfer device.

9. A grinding apparatus in accordance with claim 7, wherein said housing comprises a mounting base supporting said pedestal.

10. A grinding apparatus in accordance with claim 9, wherein said mounting base includes a yoke engaging a post portion of said fluid holder that surrounds said drive shaft and an opposite edge engaging a side portion of said fluid holder.

11. A grinding apparatus in accordance with claim 1, wherein said fluid transfer device is a brush comprising plural fibers or bristles.

12. A grinding apparatus in accordance with claim 11, wherein said fluid transfer device comprises a brush holder that secures an end portion of said plural fibers or bristles in a bundle.

13. A grinding apparatus in accordance with claim 12, wherein said brush holder comprises a clamping structure.

14. A grinding apparatus in accordance with claim 12, wherein said brush holder comprises a generally U-shaped structure.

15. A grinding apparatus in accordance with claim 12, wherein said brush holder is removably mounted to said housing.

16. A grinding apparatus in accordance with claim 15, wherein said brush holder is slideably received in a slot in said housing.

17. A grinding apparatus in accordance with claim 16 wherein said brush holder comprises a generally U-shaped structure and said housing comprises a generally U-shaped slot that receives said brush holder.

18. A fluid applicator for applying fluid from a fluid holder to a rotating grinding bit, comprising:

a fluid transfer device adapted to transfer irrigation fluid from a fluid holder into contact with a grinding bit; and a holder adapted to mount said fluid transfer device to a housing in a grinding apparatus.

19. A fluid applicator in accordance with claim 18, in combination with said housing.

20. A fluid applicator in accordance with claim 19, wherein said housing is removably mounted to said holder.

21. A fluid applicator in accordance with claim 19, wherein said housing is adapted to mount said fluid applicator to a fluid holder portion of a grinding apparatus.

22. A fluid applicator in accordance with claim 19, wherein said housing is adapted to be received in a fluid holder portion of a grinding apparatus.

23. A fluid applicator in accordance with claim 19, wherein said housing comprises a pedestal adapted to extend above a lower surface of a fluid holder portion of a grinding apparatus.

24. A fluid applicator in accordance with claim 23, wherein said housing comprises an angled slot in said pedestal to receive said holder.

25. A fluid applicator in accordance with claim 19, wherein said housing is adapted to removably mount to a fluid holder portion of a grinding apparatus.

26. A fluid applicator in accordance with claim 23, wherein said housing comprises a mounting base carrying said pedestal, said mounting base comprising a yoke adapted to engage a fluid holder post portion of a grinding apparatus and an opposite edge adapted to engage a fluid holder side portion of a grinding apparatus.

27. A fluid applicator in accordance with claim 18, wherein said fluid transfer device is a brush comprising plural fibers or bristles.

28. A fluid applicator in accordance with claim 27, wherein said holder is a brush holder adapted to secure said brush fibers or bristles in a bundle.

29. A fluid applicator in accordance with claim 28, wherein said brush holder comprises a clamping structure.

30. A fluid applicator in accordance with claim 28, wherein said brush holder comprises a generally U-shaped structure.

31. A fluid applicator in accordance with claim 30, wherein said brush holder is adapted to be received in a generally U-shaped slot in a housing in a grinding apparatus.

32. A fluid applicator in accordance with claim 18, wherein said holder is adapted to be removably mounted to a housing in a grinding apparatus.

33. A fluid applicator in accordance with claim 18, wherein said holder is adapted to be slideably received in a slot in a housing in a grinding apparatus.

34. A fluid applicator in accordance with claim 28, wherein said holder is adapted to mount to a housing in a fluid holder of a grinding apparatus containing an irrigation fluid.

35. A grinding apparatus, comprising:

a base;

an apertured support grid mounted on said base and adapted to support a work piece for grinding;

a fluid holder disposed below said support grid;

a drive shaft for rotating a grinding bit working portion above said support grid;

a power source for rotating said drive shaft; and a housing for supporting a fluid transfer device for transferring irrigation fluid from said fluid holder to a grinding bit mounted on said drive shaft.

36. A grinding apparatus in accordance with claim 35, wherein said housing is adapted to removably support a fluid transfer device.

37. A grinding apparatus in accordance with claim 35, wherein said housing is adapted to support a fluid transfer device in said fluid holder.

38. A grinding apparatus in accordance with claim 35, wherein said housing is adapted to mount a fluid transfer device to said fluid holder.

39. A grinding apparatus in accordance with claim 35, wherein said housing is in said fluid holder.

40. A grinding apparatus in accordance with claim 35, wherein said housing is removably mounted to said fluid holder.

41. A grinding apparatus in accordance with claim 35, wherein said housing comprises a pedestal extending from a lower surface of said fluid holder.

42. A grinding apparatus in accordance with claim 41, wherein said housing comprises an angled slot in said pedestal to receive a fluid transfer device.

43. A grinding apparatus in accordance with claim 40, wherein said housing comprises a mounting base supporting said pedestal.

44. A grinding apparatus in accordance with claim 43, wherein said mounting base includes a yoke engaging a post portion of said fluid holder that surrounds said drive shaft and an opposite edge engaging a side portion of said fluid holder.

45. A grinding apparatus in accordance with claim 35, wherein said housing is adapted to support a fluid transfer device of the type that comprises a brush having plural fibers or bristles.

46. A grinding apparatus in accordance with claim 45, wherein said housing is adapted to support a fluid transfer device of the type that comprises a brush having plural fibers or bristles made from hollow polyester tubules.

47. A grinding apparatus in accordance with claim 45, wherein said housing is adapted to support a fluid transfer device of the type that comprises a brush having plural fibers or bristles and a brush holder that secures an end portion of said plural fibers or bristles in a bundle.

48. A grinding apparatus in accordance with claim 45, wherein said housing is adapted to support a fluid transfer device of the type that comprises a brush having plural fibers or bristles and a brush holder comprising a clamping structure.

49. A grinding apparatus in accordance with claim 45, wherein said housing is adapted to support a fluid transfer device of the type that comprises a brush having plural fibers or bristles and a brush holder comprising a generally U-shaped structure.

50. A grinding apparatus in accordance with claim 45, wherein said housing is adapted to support a fluid transfer device of the type that comprises a brush having plural fibers or bristles and a brush holder that is removably mounted to said housing.

51. A grinding apparatus in accordance with claim 45, wherein said housing comprises a slot and is adapted to support a fluid transfer device of the type that comprises a brush having plural fibers or bristles and brush holder that is slideably received in said slot.

52. A grinding apparatus in accordance with claim 45 wherein said housing comprises a generally U-shaped slot and is adapted to support a fluid transfer device of the type that comprises a brush having plural fibers or bristles and a brush holder comprising a generally U-shaped structure that is received in said generally U-shaped slot.

* * * * *